United States Patent [19]

Smith

[11] 4,109,949

[45] Aug. 29, 1978

[54] EXTERNALLY MOUNTABLE, HIGH STRENGTH, SECURITY LOCK FOR DOORS AND THE LIKE

[76] Inventor: Donald V. Smith, 101 Conastoga Dr. #74, Carson City, Nev. 89701

[21] Appl. No.: 785,553

[22] Filed: Apr. 7, 1977

Related U.S. Application Data

[63] Continuation-in-part of Ser. No. 640,885, Dec. 15, 1975, abandoned, which is a continuation of Ser. No. 487,997, Jul. 12, 1974, Pat. No. 3,938,836.

[51] Int. Cl.[2] ..... E05C 1/10; E05B 65/06

[52] U.S. Cl. ..... 292/189; 70/97; 70/154; 292/150; 292/341.15; 292/DIG. 46

[58] Field of Search ..... 292/183-189, 292/150, 244, 145, 175, 171, 340, 341.15, DIG. 46, DIG. 53; 70/95-100, 154, 155, 462, DIG. 20, DIG. 57

[56] References Cited

U.S. PATENT DOCUMENTS

| | | | |
|---|---|---|---|
| 1,368,711 | 2/1921 | Foley | 292/244 X |
| 1,669,227 | 5/1928 | Blauser | 292/244 X |
| 1,678,982 | 7/1928 | Griffin | 292/244 X |
| 2,103,989 | 12/1937 | Machinist | 70/DIG. 57 X |
| 2,403,065 | 7/1946 | Engert | 292/340 X |
| 2,701,734 | 2/1955 | Grossman | 70/DIG. 57 X |
| 2,801,868 | 8/1957 | Carson | 292/340 X |
| 3,419,302 | 12/1968 | Frey et al. | 292/189 |
| 3,744,283 | 7/1973 | Schmidt | 70/DIG. 20 X |
| 3,934,908 | 1/1976 | Rifkin | 292/150 |

FOREIGN PATENT DOCUMENTS

| | | | |
|---|---|---|---|
| 424,550 | 2/1935 | United Kingdom | 292/244 |
| 251,006 | 4/1926 | United Kingdom | 292/145 |

*Primary Examiner*—Roy D. Frazier
*Assistant Examiner*—William E. Lyddane
*Attorney, Agent, or Firm*—Warren, Chickering & Grunewald

[57] ABSTRACT

A high strength, self loading, gravity biased security lock for positive securement of doors, windows and similar closures is disclosed. The security lock includes a pair of mounting elements, i.e., a bolt assembly and a latch assembly, formed for rapid and simple mounting of the assemblies to external surfaces of a door and door frame without the need for modifying or altering the construction of the door. The assemblies can be mounted to either right or left opening doors or floor mounted, and the fastening elements used to mount the security lock to the door are located in inaccessible positions when the lock is in the latched condition.

6 Claims, 7 Drawing Figures

EXTERNALLY MOUNTABLE, HIGH STRENGTH, SECURITY LOCK FOR DOORS AND THE LIKE

RELATED APPLICATIONS

This application is a continuation-in-part of application Ser. No. 640,885 filed Dec. 15, 1975, now abandoned, entitled "HIGH STRENGTH BOLT ASSEMBLY FOR DOORS AND THE LIKE," which application in turn was a continuation application of application Ser. No. 487,997, filed July 12, 1974, entitled "HIGH STRENGTH BOLT ASSEMBLY FOR DOORS AND THE LIKE," issued as U.S. Pat. No. 3,938,836 on Feb. 17, 1976.

BACKGROUND OF THE INVENTION

In recent years there has been a steadily increasing need for security for one's property and person. The instance of burglaries and forced entries into homes, office buildings, schools, industrial areas and other structures has steadily increased. One approach to this problem has been through the development of a multitude of alarm or warning systems, but law enforcement authorities constantly point to the need for the use of more secure locks and lock mechanisms.

One type of lock mechanism which is regarded highly by law enforcement officials is the so-called "dead bolt." This type of lock has the advantage of requiring a key to open the same from inside as well as the outside of the structure. Thus, if the door is provided with a dead bolt, a burglar cannot enter through a small opening and open a door from the inside to carry away large objects. One of the primary disadvantages, however, of a dead bolt lock mechanism is that it is somewhat difficult and costly to install. The average homeowner often is not willing to attempt to install a dead bolt and is further unwilling to pay the added cost for installation by a locksmith. Still further, a dead bolt is difficult to adapt for use in securing sliding glass doors of the type found in many modern homes.

Attempts have been made to utilize the relatively simple and inexpensive padlock as part of a locked latch or bolt mechanism. These approaches have ranged from the relatively simple systems, such as is disclosed in U.S. Pat. No. 1,376,697, which may also include padlocking together of members as shown in U.S. Pat. Nos. 1,201,940 and Re.22,918, to the relatively complex use of built-in latches or multiple padlocks, bolts and keeper bars, as shown in U.S. Pat. Nos. 3,012,430 and 3,094,861. Such simple systems are often unsuitable for use by the home owner, while the complex systems are difficult to install and require modification of the door structure, in addition to excessive expense.

In addition to dead bolts or security locks, a number of seal-type locks have been developed in which the primary objects is to detect breaking and entry, not to prevent the same. Thus, U.S. Pat. Nos. Re. 15,937, 1,004,831, 1,020,721, 1,096,759 and 995,232 are all examples of seal-type locks in which entry will require destruction of a seal, but the lock assemblies are constructed in a manner in which either the bolt assembly or the latch assembly can be relatively easily forced open or removed from the structures on which they are mounted.

OBJECTS OF THE INVENTION

Accordingly, it is an object of the present invention to provide a high strength, security lock for a door, window or the like which is simple and inexpensive to construct and may be easily mounted to an external surface of the door by simple fasteners which are inaccessible when the lock is latched.

It is another object of the present invention to provide an externally mountable, high strength, security lock for positive securement of a door, window or the like which can be mounted to right or left opening doors without modification or alteration of the same.

Still a further object of the present invention is to provide a high strength, securing lock which is reliable, easy to operate and can be intalled by means of simple tools.

The lockable bolt assembly of the present invention has other objects and features of advantage, some of which are set forth in more detail in and will be apparent from the following description and accompanying drawing.

SUMMARY OF THE INVENTION

The extremely mountable, high strength, security lock for positive securement of a door, window or the like includes a pair of assembly mounting elements, namely a bolt assembly and a latch assembly, with a first of the elements being adapted for mounting to the door proximate a door frame and the second of the elements being adapted for mounting to the door frame proximate the first of the element. A bolt, preferably a slide bolt, is mounted to one of the elements for movement to and from a bolted or latched position and an unbolted or unlatched position. The improvement of the present invention comprises, briefly, the bolt and latch assemblies being formed with mounting means positioned in a location at which the bolt prevents access to the fastening elements used to mount the assemblies to the door when the bolt is in latched position. Additionally, the mounting means is formed for external mounting of the assemblies to either right or left opening doors. The high strength bolt assembly of the present invention preferably includes a self loading, gravity-biased, slide bolt particularly well suited for mounting to sliding glass doors.

DESCRIPTION OF THE PREFERRED EMBODIMENTS

Figure 1:
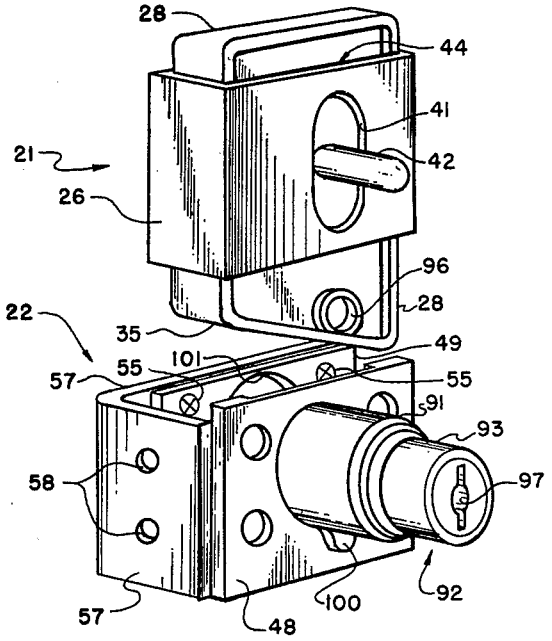
FIG. 1 is a top perspective view of an externally mountable, high strength, security lock constructed in accordance with the present invention.

The security lock of the present invention can be mounted to doors, windows, and similar closure means for various openings. As used herein, the word "door" shall include windows and other closure means. Moreover, the security lock may be mounted to a pair of doors both of which are movable, as well as a door and a stationary door frame. Accordingly, the expression "door frame" shall include frames for doors and windows, a second door or window, which itself can be opened or closed, and the floor or ceiling which provides a surface defining the opening in which a door or window is mounted.

Referring now to FIGS. 1 through 4, the security lock of the present invention can be seen to include a pair of mounting elements, namely, a bolt assembly, generally designated 21, and a latch assembly, generally designated 22, formed for mounting to the external surfaces of door 23 and door frame 24 by fastening elements. It is preferable that bolt assembly 21 include a bolt housing 26 which extends transversely around and defines a vertically extending guideway 27 in which slide bolt member 28 is mounted for sliding vertical reciprocation to and from a latched and an unlatched position. In the latched position, bolt 28 extends down into the open top 29 of latch assembly 22 for cooperative engagement with the latch assembly in a manner enabling locking of the two assemblies together as a unit.

The security lock of FIGS. 1–4 is particularly well suited and designed for mounting to a sliding glass door or window of the type conventionally found in residences. These doors are particularly difficult to secure in a positive manner and do not lend themselves, for example to the mounting of a conventional dead bolt structure, since substantial modification and alteration of the door and door frame is required. Thus, in FIGS. 3 and 4, a door and door frame structure of the type conventionally found in residences is illustrated in phantom. Door 23 includes a vertical structural element 31 formed for receipt and mounting of a glass pane 32 thereto. Cooperatively mating with the vertical structural element 31 is a door frame molding including protruding flange portion 33 and casing portion 34, both of which normally extend over the full height of the door. The door frame 24 also includes upper and lower track portions (not shown) formed for guided sliding reciprocation of door 23.

Figure 2:
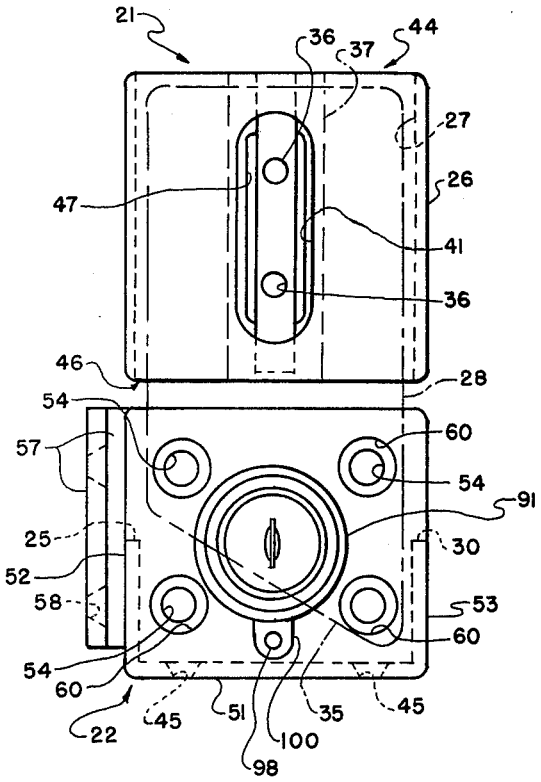
FIG. 2 is a slightly enlarged, front elevational view of the lock of FIG. 1.
Figure 3:
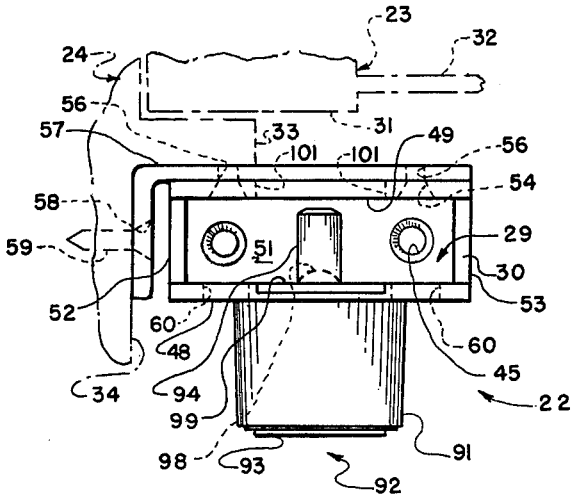
FIG. 3 is a top plan view of the latch assembly portion of the security lock of FIG. 1 shown mounted to a sliding door with the lock in locked position.
Figure 4:
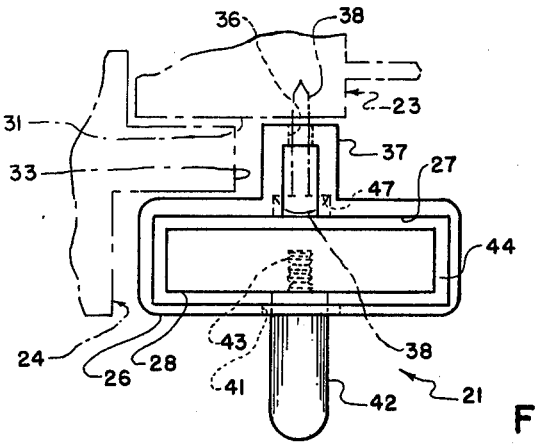
FIG. 4 is a top plan view of the bolt assembly portion of the security lock of FIG. 1 shown mounted to a sliding door.

The security lock of the present invention is formed for rapid and easy mounting to a door and door frame structure by the use of simple fastening elements and conventional tools. Thus, in the improved security lock of the present invention, bolt assembly 21 and latch assembly 22 are each formed with mounting means, preferably a series of fastener receiving openings, for securing fastener elements thereto, and each of the mounting means is positioned in a location at which bolt member 28 prevents access to the fastening elements for removal thereof when bolt member 28 is in the latched position. Referring to FIGS. 2 and 4, the mounting means for latch assembly 21 can be seen to be comprised of openings 36 in the rearwardly projecting portion 37 of bolt housing 26. Mounted in openings 36 are fasteners 38 (FIG. 4) which extend into the vertical structural member 31 of door 23.

In order to provide access to fastening element 38, bolt housing 26 is preferably formed with an elongated vertically extending slot 41 through which manually engageable slide bolt handle 42 protrudes. Bolt handle 42 is removably mounted, for example, by a threaded connection 43 (FIG. 4) into the body of bolt member 28 so that removal of handle 42 allows the bolt to be reciprocated either upwardly or downwardly out of the open top 44 or open bottom 46 of the housing. Once the bolt has been removed, slot 41 provides a convenient access to openings 36 for mounting of fasteners 38 therein and securement of the fasteners and bolt assembly 21 to the door. It should be noted that it is preferably for fastener 38 to be formed as a screw having a head which is positioned in a recess 47 so that bolt 28 will not engage the same during vertical reciprocation. When the bolt is in place, however, openings or mounting means 36 can be seen to be inaccessible or disposed between the bolt and the structural element 31 to which the bolt assembly is secured.

Latch assembly 22 is similarly constructed so that it may be easily mounted to a door frame by fastening elements such as screws and yet the fastening elements are positioned behind bolt 28 when the bolt is in latched position, in which position it can be locked to the latch assembly. Latch assembly 22 may be conveniently formed as an opened top housing comprised of a front wall 48 and rear wall 49 connected by closed bottom 51 and side walls 52 and 53. Formed in the rear wall 49 are a plurality of openings 54 through which fasteners 55 (FIG. 1) are positioned. The fasteners 55 are preferably machine screws which extend through and are threadably received by openings 56 (FIG. 3) in a first leg of L-shaped mounting bracket 57 which extends behind and abuts the rear wall 49 of the latch housing. In order to provide for mounting of the bracket and latch housing to door frame 24, a second leg of the L-shaped bracket 57 is formed with openings 58 through which fastening elements 59 can be used to secure the bracket and latch assembly to door frame casing 34.

In order to mount the latch assembly to door frame casing 34, the L-shaped bracket 57 and latch assembly housing are first separated. The L-shaped bracket is then mounted by fasteners 59 to casing 34, and then the housing is mounted by fasteners 55 to bracket 57. For this latter step, the front wall 48 of the latch assembly housing is provided with a plurality of large openings 60 which can be seen to be axially aligned with openings 54 in the rear of the housing. Openings 60 are dimensioned for receipt of a tool such as a screw driver so that the fastening elements 55 can be screwed into bracket 57. FIG. 2 shows bolt member 28 in phantom in a latched position inside latch assembly housing. In this latched position, it will be appreciated that the bolt member 28 is interposed between openings 60 and openings 54, at least as to three of the four openings. Thus, when the bolt is in the latched position, three of the fasteners 55 are inaccessible to prevent removal of the latch housing from L-shaped bracket 57. Similarly, bolt member 28 prevents access to the upper fastening element 59, and the lower fastening element 59 is behind side wall 52. If the bolt is reciprocated upwardly to an unlatched position, however, fasteners 55 are exposed and accessible enabling unmounting of the security lock, if desired.

Alternatively, it is possible to mount latch assembly 22 to the door frame without using L-shaped bracket 57. Formed in the bottom wall 51 of the latch assembly housing are fastener receiving openings 45. Openings 45 can be used to mount latch assembly 22 to a lower surface defining door frame 24. Thus, the latch assembly can be mounted to the track along the floor of the door frame casing, with the bolt assembly being mounted to the door immediately above the latch assembly.

A second important aspect of the externally mountable, high strength, security lock of the present invention is that the bolt assembly and latch assembly mounting means are universally formed for mounting and attachment to doors which open from either a left side or a right side of the door frame. As shown in FIGS. 1 through 4, the latch assembly is oriented for mounting to the inside of a door which opens from the left side of the door frame. If the door were to open from the right side of the door frame, one need only reverse L-shaped bracket 57 and remove handle 42 so that the bolt could be reversed so that tapered lower surface 35 of the bolt would face in the opposite direction of that shown in FIGS. 1 and 2. The mounting procedure would then be the same as above described in connection with mounting the security lock to the inside of the door opening from the left side of the door frame.

In addition to providing universal mounting means for the security lock, the latch assembly must be formed in a manner so that it will latch for either right opening or left opening doors. As shown in FIGS. 1 through 4, the bolt 28 is gravity biased to a lowermost position at which point manually engageable portion 42 engages the bottom of slot 41. As door 23 is moved toward the closed position of FIGS. 3 and 4, the lower tapered surface 35 of the bolt assembly engages the top surface 30 of side wall 53 of the latch housing. Top surface 30, therefore, acts as a striker plate surface and automatically upwardly displaces bolt 28 against gravity until the far side of the plate passes beyond side wall 53. At this point, the bolt is gravity biased down to the position shown to the position shown in FIG. 2. When the security lock is to be mounted to a door opening from the right side of the door frame, L-shaped bracket 57 is reversed as is bolt 28. The lower tapered surface of bolt 28 now first engages the top surface 25 of side wall 52, which acts as a second striker plate surface. In each instance, of course, bolt 28 must be mounted at a vertical height so that the lower tapered surface engages the striker plate surfaces in the latch assembly, rather than a side of the bolt.

Although there are a number of manners in which the slide bolt 28 can be locked to latch assembly 22, it is preferable to form latch assembly 22 with a barrel-like protrusion 91 into which a key lock, generally designated 92, is mounted. The key lock will conventionally include an axially displaceable barrel portion 93 and an axially displaceable locking rod 84 (FIG. 3) formed and dimensioned for insertion into transverse opening 96 in slide bolt 28. In operation, therefore, after bolt 28 drops to the position shown in FIG. 2, the barrel 93 can be manually pushed inwardly to cause bar 94 to be inserted into opening 96 in the slide bolt. To open the lock, a key is inserted in keyhole 97 and turned, with the barrel 93 being resiliently biased outwardly so that it automatically pops out pulling the locking bar 94 out of opening 96 and freeing the slide bolt for upward movement.

The lock can be mounted in barrel 91 by means of a fastener 98 (FIG. 3) which engages flange 99 and is threadably received in boss 100 in the latch housing. The rear wall 49 of the latch housing is formed with an opening 101 dimensioned for insertion of the lock 92 into the boss 100 and to provide access to fastener 98 so as to secure the lock to the latch housing. Again, bolt 28 prevents access to fastener 98 holding the lock in the latch housing.

Figure 5:
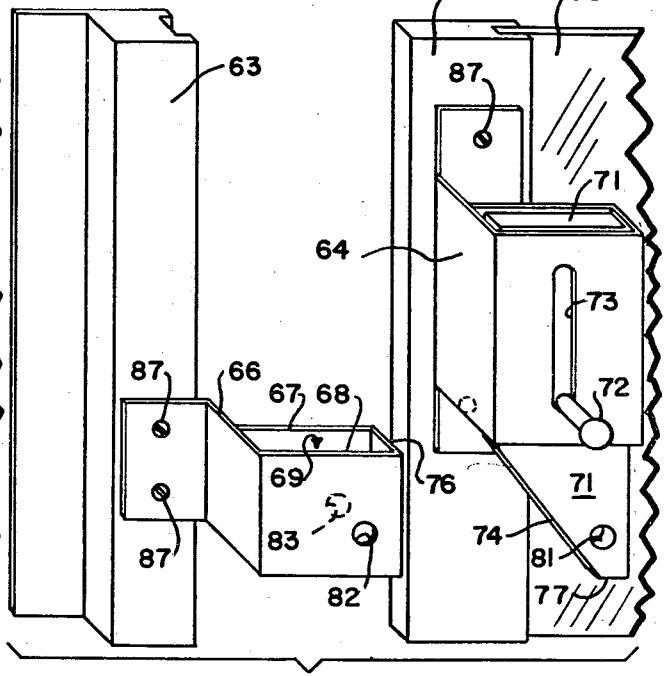
FIG. 5 is a fragmentary, top perspective view of an alternative embodiment of the security lock of the present invention showing the door in an open position.
Figure 6:
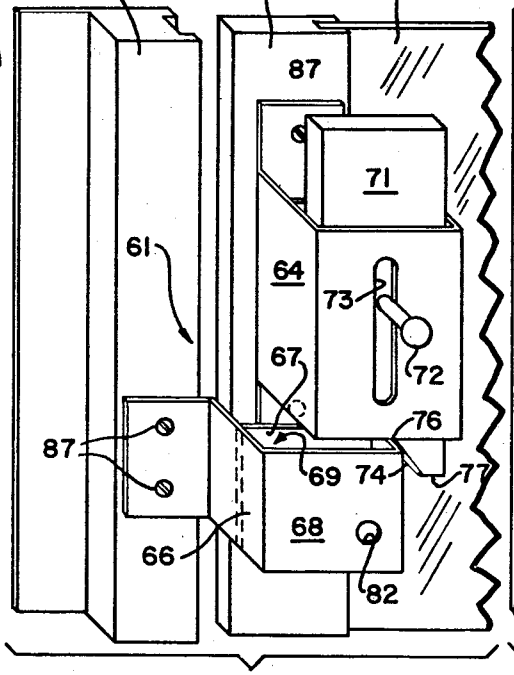
FIG. 6 is a fragmentary, top perspective view of the security lock of FIG. 5 showing the door in a partially closed position.
Figure 7:
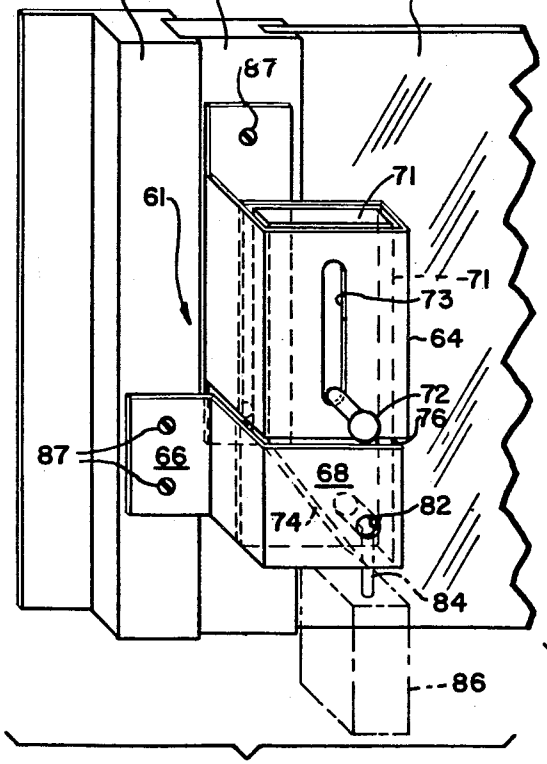
FIG. 7 is a fragmentary, top perspective view of the security lock of FIG. 5 showing the door in a fully closed position.

Referring now to FIGS. 5, 6 and 7, an alternative embodiment of the security lock of the present invention may be described. A bolt assembly, generally designated 61, may be seen to be mounted to sliding door 62 and door frame 63. The sliding door includes a glass pane 65 and is constructed in a conventional manner. Mounted to the stile of door 62 is assembly mounting element 64, while a second mounting element 66 is mounted to door frame 63 proximate, but in this case below, first mounting element 64. Second mounting element 66 includes a pair of side-by-side flange portions 67 and 68 which define slide bolt receiving slot 69 therebetween. Mounted to element 64 is slide bolt 71 having manually engageable handle 72 extending outwardly through slot 73 in the mounting element. As so mounted, slide bolt 71 is gravity biased to the downward position, which is the bolted position, as best may be seen in FIG. 5.

In order to provide for an automatic loading of the assembly to the bolted position upon closing of door 62, slide bolt 71 is preferably formed with a tapered lower surface 74 which is adapted to slidably engage the edge or striker plate surface 76 of mounting element 66 and thereby move bolt 71 against gravity from the bolted position to an unbolted position. This enables end 77 of the slide bolt to pass over edge 76 so that the bolt may enter slot 69. Thus, as door 62 is closed, edge 76 and tapered surface 74 causes bolt 71 to be progressively upwardly urged, as is shown in FIG. 6, until end 77 passes over edge 76 of the mounting element and enables slide bolt 71 to drop downwardly automatically under the influence of gravity to the bolted position of FIG. 5. The bolt assembly may be opened by engaging handle 72 and sliding the bolt upwardly, after which door 62 may be opened.

As was the case with the previously described embodiment of the bolt assembly of the present invention, slide bolt 71 is provided with transverse opening or channel 81 for locking the slide bolt to the latch mounting element. Opening 81 is positioned in alignment with openings or channels 82 and 83 formed in flange portions 67 and 68, when the bolt is in the bolted position shown in FIG. 5. As so aligned, a shackle 84 of a padlock 86 may be passed through aligned openings 81, 82 and 83 to positively lock the assembly against opening.

The high strength bolt assembly of FIGS. 5, 6 and 7 may be easily installed by means of fasteners 87 to provide the homeowner with what would be the equivalent of a dead bolt for a sliding glass door. Fasteners 87, however, may advantageously be formed with one-way screw heads, welded, soldered or otherwise locked against removal for added security.

What is claimed is:

1. A reversibly mountable, gravity biased, security lock for external attachment to a right or left opening door or the like in order to enable securement of said door to a door frame, said security lock including a bolt assembly having bolt assembly mounting means formed for mounting said bolt assembly to one of said door and said door frame and having a bolt member mounted thereto for movement to and from a latched and an unlatched position, and a latch assembly having latch assembly mounting means formed for mounting said latch assembly to a remainder of said door and said door frame proximate said bolt assembly, said bolt member being formed with a tapered lower surface and being formed for removal from said bolt assembly and remounting therein with said tapered lower surface in a reversed position, wherein the improvement in said security lock is comprised of:

said latch assembly is formed with a pair of striker plate surfaces positioned on oppositely facing sides of said latch assembly;

said latch assembly mounting means is formed for mounting of said latch assembly proximate a right and a left opening door with one of said striker plate surfaces positioned for cooperative engagement with said tapered lower surface of said bolt member;

said bolt member being mounted in said bolt assembly for automatic, unimpeded, upward displacement of said bolt member upon engagement of said tapered lower surface with one of said striker plate surfaces as said door is moved to a closed position and for automatic gravity biased downward displacement of said bolt member to said latched position to effect latching of said bolt member with said latch assembly when said bolt member passes beyond said one of said striker plate surfaces;

lock means formed and mounted to said latch assembly for selective locking of said bolt member directly to said latch assembly in said latched position; and said bolt assembly, latch assembly, bolt assembly mounting means and latch assembly mounting means being formed to prevent removal of said bolt assembly and said latch assembly from said door and door frame when said bolt member is locked to said latch assembly.

2. A security lock as defined in claim 1 wherein, said latch assembly mounting means includes a mounting bracket formed for removal from said latch assembly and remounting thereto in a reversed position to enable mounting of said latch assembly proximate a right and a left opening door.

3. A security lock as defined in claim 2 wherein, said latch assembly mounting means is formed with a plurality of fastener receiving openings in a downwardly facing portion thereof for floor mounting on a lower door frame defining member.

4. A security lock as defined in claim 2 wherein, said latch assembly mounting means includes a plurality of fastener receiving openings in a back portion of said latch assembly and said L-shaped mounting bracket is formed with a first set of fastener receiving openings in a leg thereof mating and in alignment with said openings in said back portion and a second set of fastener receiving openings in a perpendicular leg of said bracket.

5. A security lock as defined in claim 1 wherein, said latch assembly includes a pair of adjacent flange portions defining an upwardly opening slot therebetween dimensioned for receipt of said bolt member;

said bolt assembly mounting means and said latch assembly mounting means being formed for superimposition of said bolt member above said slot when said door is in a closed position;

said striker plate surfaces connecting said flange portions; and lock means mounted to said latch assembly and formed to positively and directly interlock at least one of said flange portions with said bolt member when said bolt member is in said latched position.

6. A security lock as defined in claim 5 wherein, at least one of said flange portions and said bolt member are formed with openings therein, said openings being positioned in registered alignment when said bolt member is in latched position, and said lock means being mounted to said latch assembly through the opening in said flange portion.

* * * * *